US006035555A

United States Patent [19]

Pavelescu et al.

[11] Patent Number: 6,035,555

[45] Date of Patent: Mar. 14, 2000

[54] WATERPROOF SHOE

[75] Inventors: Liviu-Mihai Pavelescu, Wuppertal; Manfred Haderlein, Haan, both of Germany

[73] Assignee: Akzo Nobel, NV, Arnhem, Netherlands

[21] Appl. No.: 09/101,466

[22] PCT Filed: Jan. 8, 1997

[86] PCT No.: PCT/EP97/00042

§ 371 Date: Aug. 4, 1998

§ 102(e) Date: Aug. 4, 1998

[87] PCT Pub. No.: WO97/24940

PCT Pub. Date: Jul. 17, 1997

[30] Foreign Application Priority Data

| | | | |
|---|---|---|---|
| Jan. 10, 1996 | [DE] | Germany | 196 00 532 |
| Mar. 22, 1996 | [DE] | Germany | 196 11 336 |

[51] Int. Cl.[7] ..... A43C 13/00

[52] U.S. Cl. ..... 36/14; 36/44; 36/55; 36/12

[58] Field of Search ..... 36/4, 10, 12, 14, 36/44, 45, 55, 98

[56] References Cited

U.S. PATENT DOCUMENTS

| | | | |
|---|---|---|---|
| 1,871,211 | 8/1932 | Cook | 36/12 |
| 3,757,436 | 9/1973 | Winkler et al. | 36/12 |
| 4,899,465 | 2/1990 | Bleimhofer et al. . | |
| 5,285,546 | 2/1994 | Haimerl | 36/12 |
| 5,505,011 | 4/1996 | Bleimhofer | 36/4 |
| 5,628,127 | 5/1997 | Nötzold . | |
| 5,678,326 | 10/1997 | Pavelescu | 36/55 |
| 5,689,903 | 11/1997 | Aumann | 36/12 |
| 5,779,834 | 7/1998 | Pavelescu et al. | 36/12 |

FOREIGN PATENT DOCUMENTS

| | | | |
|---|---|---|---|
| 0 544 270 | 6/1993 | European Pat. Off. . | |
| 0 679 347 A2 | 4/1995 | European Pat. Off. . | |
| 0 729 716 | 9/1996 | European Pat. Off. . | |
| 3 821 602 A1 | 3/1989 | Germany . | |
| 4000156 | 11/1991 | Germany . | |
| 4 138 836 A1 | 5/1993 | Germany . | |
| 44 19 802 | 12/1995 | Germany . | |
| 195 23 582 | 1/1997 | Germany . | |
| WO 90 06067 | 6/1990 | WIPO . | |
| 93/00837 | 1/1993 | WIPO | 36/55 |
| 95/00045 | 1/1995 | WIPO | 36/55 |
| WO 96 41548 | 12/1996 | WIPO . | |

*Primary Examiner*—Paul T. Sewell
*Assistant Examiner*—J. Mohandesi
*Attorney, Agent, or Firm*—Oliff & Berridge, PLC

[57] ABSTRACT

A waterproof shoe structure including at least part of a shoe, has an outer layer, a lining including a functional layer that is waterproof but permeable to water vapor, an insole, and an outsole. The lining containing the functional layer has a lower end area that is turned in and arranged parallel to the outsole, the turned-in end area lies in a common plane with the insole and has an inner edge and an outer edge, the outer edge of the insole runs at least approximately parallel to the inner edge of the turned-in end area, and the insole is joined to the turned-in end area. The outsole is applied by adhesive over a full surface thereof at least to the turned-in end area of the functional layer of the lining, and the lower end of the upper layer is arranged substantially perpendicular to the outsole and at least in a shank area thereof is joined to a retainer arranged parallel to the outsole, and/or at least in a toe area thereof a netting of monofilaments is joined to the lower end of the outer layer. The lining inside the outer layer is arranged in a detached manner.

19 Claims, 4 Drawing Sheets

WATERPROOF SHOE

BACKGROUND OF THE INVENTION

1. Field of the Invention

The invention relates to a waterproof shoe structure comprising at least a part of a shoe and having an outer layer (1), a lining (2) with a functional layer that is waterproof but permeable to water vapor, an insole (3), and an adhesive-applied outsole.

2. Description of Related Art

A shoe with such a structure is described in the unpublished German patent application with reference number 195 13 413.3-26. This shoe is manufactured in an adhesive lasting process and serves to increase wearer comfort. With this type of shoe it is recommended to affix outsoles with adhesive and as well to apply them by injection molding.

In the past, the development of waterproof shoes whose comfort is increased by a functional layer that is waterproof but permeable to water vapor, and that as a rule is integrated into the lining layer, was mainly one in connection with shoes having an outsole that is produced by injection molding, because the molding material used in the production of the outsoles guaranteed of its own accord good watertightness from underneath and allowed a good bond with the outer material.

A shoe with injection molded outsole is known from EP-A-0 544 270 in which the lower end of the lining is turned in and arranged parallel to the outsole. The outer edge of the insole is sewn to the terminating edge of the lining. A sole is molded onto this structure. To ensure shape stability during manufacture, the lining in the lower area is glued to the outer layer. This design cannot be readily applied to shoes with adhesive-applied sole, since the forces required to apply the sole are considerably greater than when injection molding an outsole, and the lining is therefore subjected to considerable stress, possibly leading to tears in the waterproof, water-vapor permeable functional layer in the lining and to leakage.

SUMMARY OF THE INVENTION

The object of the present invention is to provide an additional waterproof shoe structure with an adhesive-applied outsole, which structure is not manufactured only as an adhesive lasting process. In particular, the invention has the objective of providing a shoe structure in a sewn style (Strobel process) that can be fitted with an adhesive-applied outsole.

BRIEF DESCRIPTION OF THE DRAWINGS

The invention will be illustrated in greater detail by means of the following figures.

DETAILED DESCRIPTION OF PREFERRED EMBODIMENTS

Figure 1:
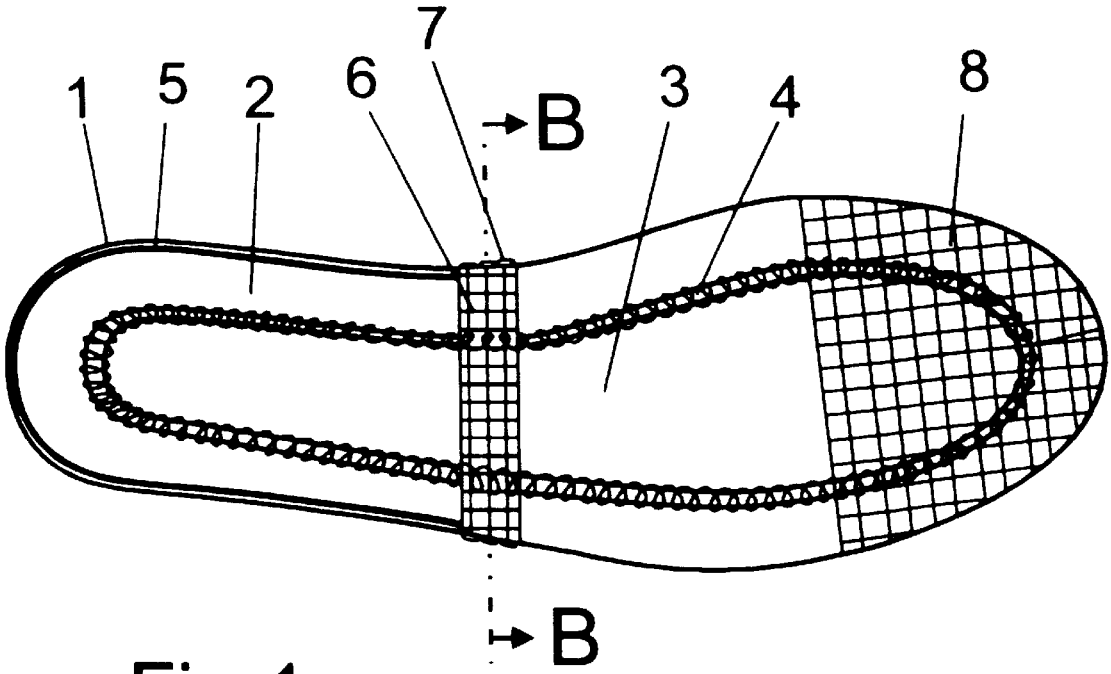
FIG. 1 shows a bottom view of a shoe in accordance with the invention, without an outsole.

The object of the invention is satisfied by a waterproof shoe structure comprising at least a part of a shoe, having an outer layer, a lining with a functional layer that is waterproof but permeable to water vapor, an insole, and an outsole, whereby the lining containing the functional layer has a lower end area that is turned in and arranged parallel to the outsole, the turned-in end area lies in a common plane with the insole and has an inner edge, the outer edge of the insole runs at least approximately parallel to the inner edge of the turned-in end area, and the insole is joined to the turned-in end area, the structure being characterized in that the outsole is applied by adhesive over the surface at least to the turned-in end area of the functional layer of the lining, the lower end of the upper layer is arranged substantially perpendicular to the outsole and at least in the shank area is joined to a retainer arranged parallel to the outsole and/or at least in the toe area a netting of monofilaments is joined to the lower end of the outer layer, and that the lining inside the outer layer is arranged in a detached manner.

As noted, the lower end area should be in a plane with the insole. This means that the lower end area of the lining and the insole should be arranged in such a way that both the end area of the lining and the insole lie flat on the outsole. This does not rule out, however, that the insole and the lower end area of the lining might overlap. But there can readily be a separation between the inner edge of the end area of the lining and the outer edge of the insole. In this case, the insole is preferably sewn to the turned-in end area of the lining (Strobel process). In sewing these two parts, a separation can readily be bridged by the threads forming the seam.

An essential element of the present invention is that the adhesive used to affix the outsole creates a waterproof bridge between the functional layer and the outsole. This can be achieved by using a very thin layer of adhesive so that an intimate bond is achieved between the outsole and the functional layer. A thicker adhesive layer can also be used, but adhesives are then preferably employed that are waterproof after setting. In this case, polyurethane adhesives are excellently suited.

It is also advantageous if, at least in the toe area, a netting of monofilaments is joined to the lower end of the outer layer, preferably by sewing, and the shape of the toe area of the outer layer is thereby stabilized.

In the shoe structure of the invention, a direct connection between the lining and the outer layer, for example gluing the lining to the outer layer, can be dispensed with completely. In other words: the lining inside the outer layer is arranged in a detached manner or is joined only to the upper edge of the outer material, i.e., the edge facing away from the sole and representing the opening for inserting the foot.

The dimensional stability of the shoe structure during the manufacturing process can also be improved by joining, preferably by sewing and at least in the shank area, a netting of monofilaments to the lower ends of the outer layer, thus stabilizing the shape of the outer layer. This netting can, however, also extend over the entire foot area if precise retention of the shape of the shoe structure is required, for example.

To provide dimensional stability during the manufacturing process, it has also proven favorable to extend the outer layer downward in the toe area and then turn it in, so that the turned-in part of the outer layer is arranged parallel to the outsole. In this connection it is advantageous if a wedge is cut out directly at the tip and the edges thus produced are sewn together. This method of stabilizing the shape is also described in the yet unpublished German patent application with reference number 195 13 412.5 for shoes with injection molded sole.

In the heel area as well, it has proven advantageous to extend the outer layer in the heel area downward and to turn it in such a way that the turned-in part of the outer layer is arranged parallel to the outsole. In this case, it has proven beneficial if, in the area where the outer layer is turned in, the outer contour of insole abuts the functional layer, and the outer layer, together with the functional layer, is turned over the outer contour of the insole. perpendicular to the outsole and join it, at least in the area of the shank, to a retainer that is parallel to the insole.

It is also advantageous if, at least in the toe area, a netting of monofilaments is joined to the lower end of the outer layer, preferably by sewing, and the shape of the toe area of the outer layer is thereby stabilized.

At least the two latter embodiments allow dispensing with any direct connection between the lining and the outer layer, for example gluing the lining to the outer layer. In other words: the lining inside the outer layer is arranged in a detached manner or is joined only to the upper edge of the outer material, i.e., the edge facing away from the sole and representing the opening for inserting the foot.

The dimensional stability of the shoe structure during the manufacturing process can also be improved by joining, preferably by sewing and at least in the shank area, a netting of monofilaments to the lower ends of the outer layer, thus stabilizing the shape of the outer layer. This netting can, however, also extend over the entire foot area if precise retention of the shape of the shoe structure is required, for example.

To provide dimensional stability during the manufacturing process, it has also proven favorable to extend the outer layer downward in the toe area and then turn it in, so that the turned-in part of the outer layer is arranged parallel to the outsole. In this connection it is advantageous if a wedge is cut out directly at the tip and the edges thus produced are sewn together. This method of stabilizing the shape is also described in the yet unpublished German patent application with reference number 195 13 412.5 for shoes with injection molded sole.

In the heel area as well, it has proven advantageous to extend the outer layer in the heel area downward and to turn it in such a way that the turned-in part of the outer layer is arranged parallel to the outsole. In this case, it has proven beneficial if, in the area where the outer layer is turned in, the outer contour of insole abuts the functional layer, and the outer layer, together with the functional layer, is turned over the outer contour of the insole.

Shape stabilization can also be ensured by forming the lower end area of the outer layer as a drawstring passage. This can be accomplished by turning back the lower end area and joining it to the outer layer, and inserting into the resulting passage a cord by which the lower end of the outer layer is held. In this connection it has proven quite advantageous if the drawstring passage is arranged in the toe area of the shoe structure and extends approximately to the shank area of the shoe structure and if the free ends of the drawstring cord in the shank area are directed inward and parallel to the outsole and joined together.

It is of particular benefit for the cord to be a monofilament, because the cord can then be completely enveloped by the adhesive. If multifilament threads are used for the cord, some embodiments involve the risk that water can penetrate to the insole via capillary action in the cord.

As mentioned previously, it is especially advantageous to bond the outsole to the functional layer using a waterproof adhesive. If a material is chosen for the outsole which is not completely waterproof, such as leather, it is recommended to also glue the insole to the outsole using a waterproof adhesive in order to provide a barrier layer and thus counteract possible penetration of water via the outsole.

The waterproof shoe structure in accordance with the invention preferably exhibits a lining that is a laminate, in which a lining layer is joined to the functional layer. A membrane marketed under the trademark SYMPATEX has proven quite successful as a functional layer.

In special cases, it can be of advantage to have the side of the functional layer facing away from the lining layer joined to a textile reinforcing layer and to carry out the adhesive application of the outsole to the end area of the functional layer in such a manner that the textile reinforcing layer is completely embedded in the layer of adhesive necessary for bonding. In this connection, it is important that the layer of adhesive completely envelop the threads of the textile reinforcing layer to ensure a waterproof barrier from the outside. In particular, monofilaments should also be used for the textile reinforcing layer to effectively prevent the seepage of water caused by capillary action, as is often observed in the case of multifilament yarns.

In this connection it is especially beneficial if the adhesive bonding the outsole to the functional layer also includes the inner edge of the turned-in end area of the functional layer. In the case in which the adhesive does not completely penetrate the textile fabric of the lining arranged toward the sole, but does include the inner edge of the turned-in end area of the lining, the adhesive can effect an intimate bond with the functional layer at the latter locations, because this functional layer is easily accessible at the edge.

Figure 2:
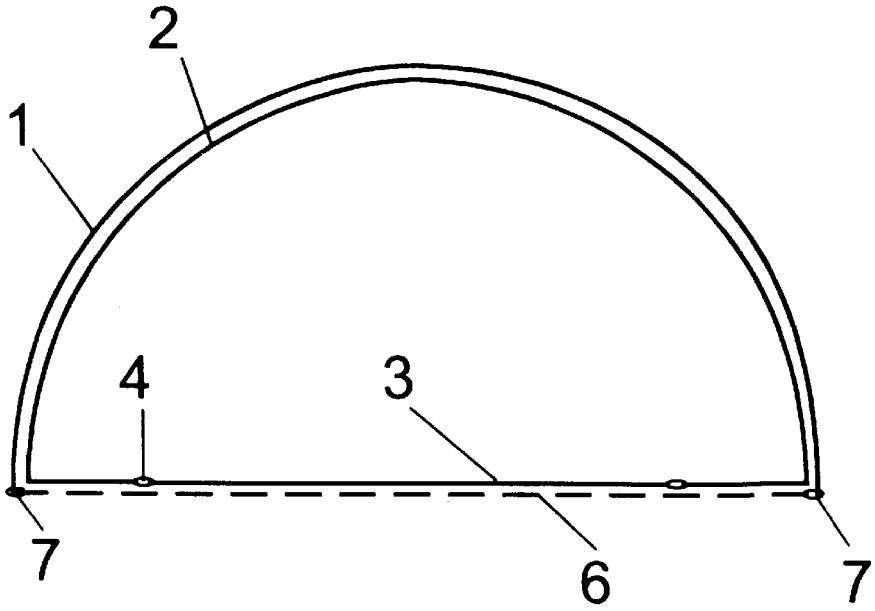
FIG. 2 shows the cross-section B—B of the shoe according to FIG. 1.

In FIGS. 1 and 2, the outer layer is indicated by 1. Within the outer layer 1 is a lining 2, the lower area of which is turned in, and the inner edge of this turned-in end area extends up to seam 4. Seam 4 joins the lower end area of lining 2 with an insole 3, whose outer edge also is located in the area of seam 4. The heel area is reinforced by means of a counter 5. In the shank area there is a monofilament netting 6 that is sewn to the outer layer 1 via seam 7. Likewise, in the toe area a netting 8 is sewn to the outer layer 1 via a seam, not shown. In accordance with the invention, lining 2 consists of a laminate which has on the foot side a lining layer and on the sole side a functional layer to which the sole, not shown, is affixed. The essential point is that the adhesive provides full-surface contact between the sole and the functional layer to prevent water from seeping in from the outside toward insole 3. As a rule, insole 3 is affixed to the outsole as well. This is recommended in any case if a material is chosen for the sole that absorbs water over time, as is the case with non-impregnated leather, for example. It is also an advantage if the lining has a textile reinforcing layer on the side of the functional layer that is not in contact with the foot.

Figure 3:
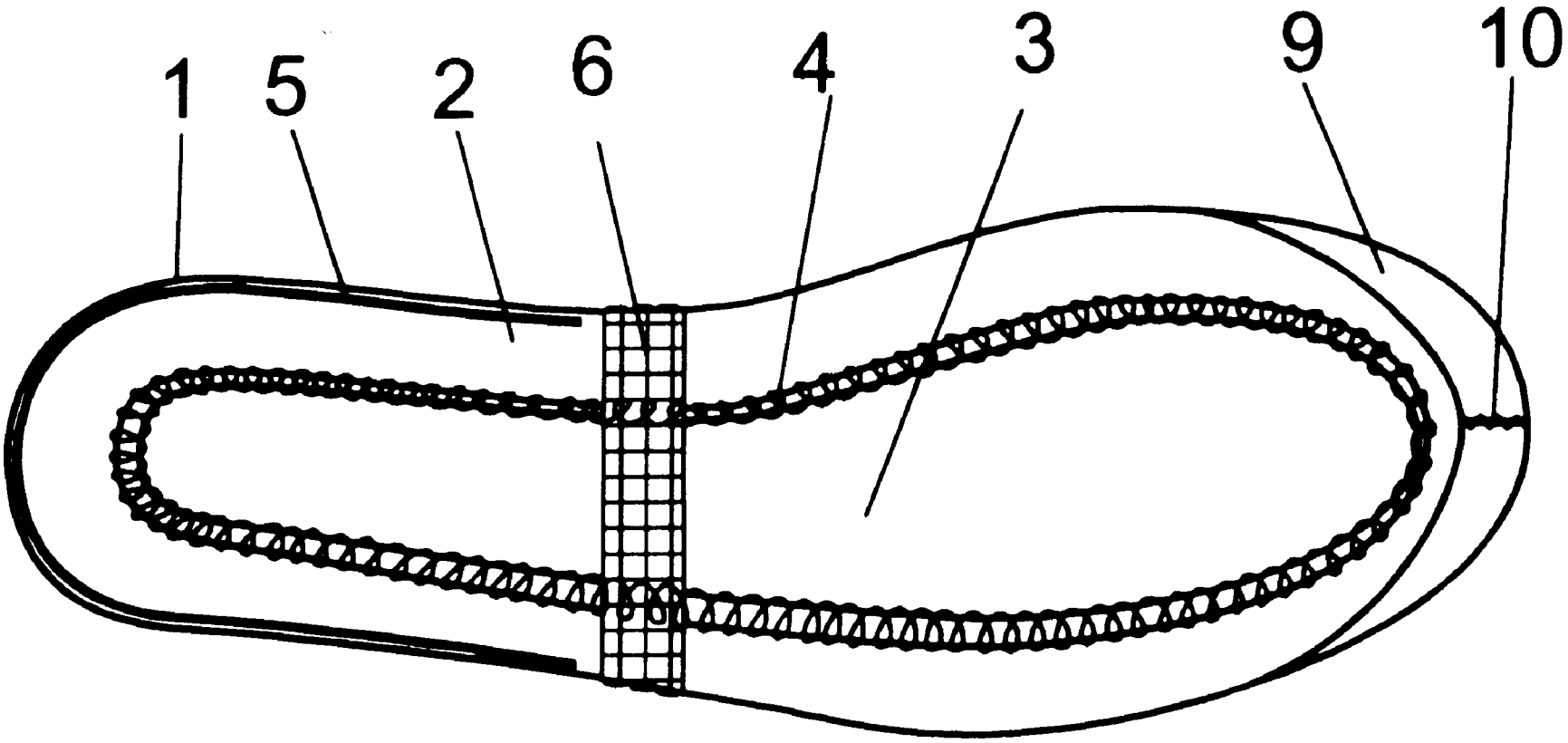
FIG. 3 shows a bottom view of an additional shoe in accordance with the invention, also with no outsole.

FIG. 3 shows a further embodiment of the shoe of the invention in which the components that are identical to the embodiment shown in FIGS. 1 and 2 are indicated by identical numbers. These components will not be described again. In this embodiment the outer layer in the toe area is turned in (area 9). Directly at the tip, a wedge has been cut out of the outer layer. The edges of the outer layer resulting from cutting out the wedge are joined together by a seam 10. In area 9 of outer layer 1, which is turned in, additional wedges can be cut out, and, again, all resulting edges must be joined by seams. In the lower end area of the lining as well, it is advisable in all areas where the shoe has a relatively small radius, as is the case in the toe and heel areas, to cut into the turned-in lining and to join the resulting edges in a waterproof manner. This waterproof joint can be achieved, for example, by affixing with adhesive. It is also possible to sew the edges created by cutting out a wedge, but the seam must then be made watertight in an effective manner. This can, for example, be achieved using a waterproof tape which completely covers the area of the seam. The watertightness of such seams must at least be guaranteed on the side of the lower end area of the functional layer that faces the outsole, so that a perfect seal is achieved.

Figure 4:
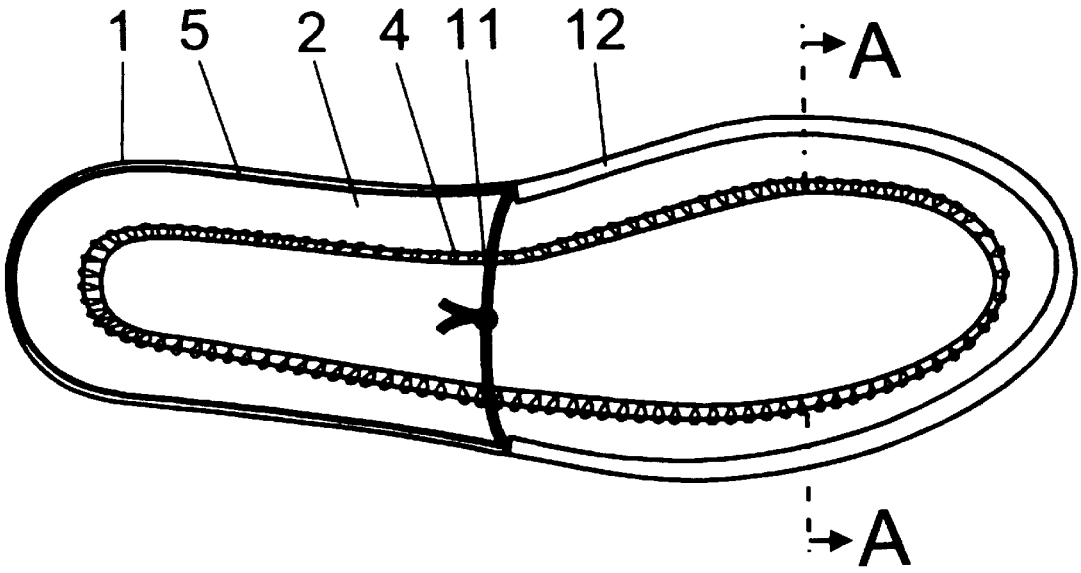
FIG. 4 shows a bottom view of an additional shoe in accordance with the invention, again without an outsole.
Figure 5:
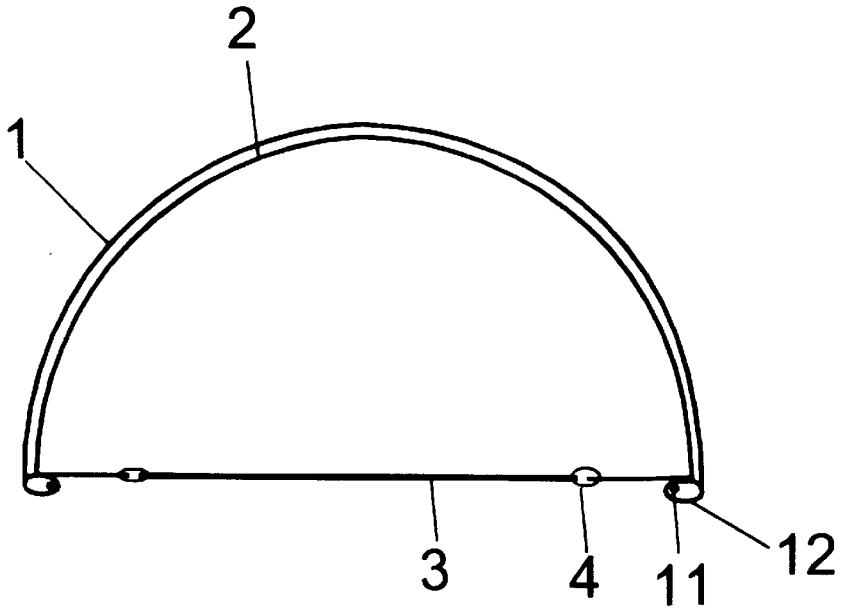
FIG. 5 shows the cross-section A—A of the shoe according to FIG. 4.

FIGS. 4 and 5 show a further embodiment of the shoe in accordance with the invention, and, again, components identical to FIGS. 1 to 3 are referred to by identical numbers. The lower end of outer layer 1 is formed into a drawstring passage 12, also referred to as a tunnel, in which a cord 11 is inserted. Drawstring passage 12 reaches from the toe area to the shank area of the shoe, where both ends of the cord emerge from the passage and are tied in a knot.

Figure 6:
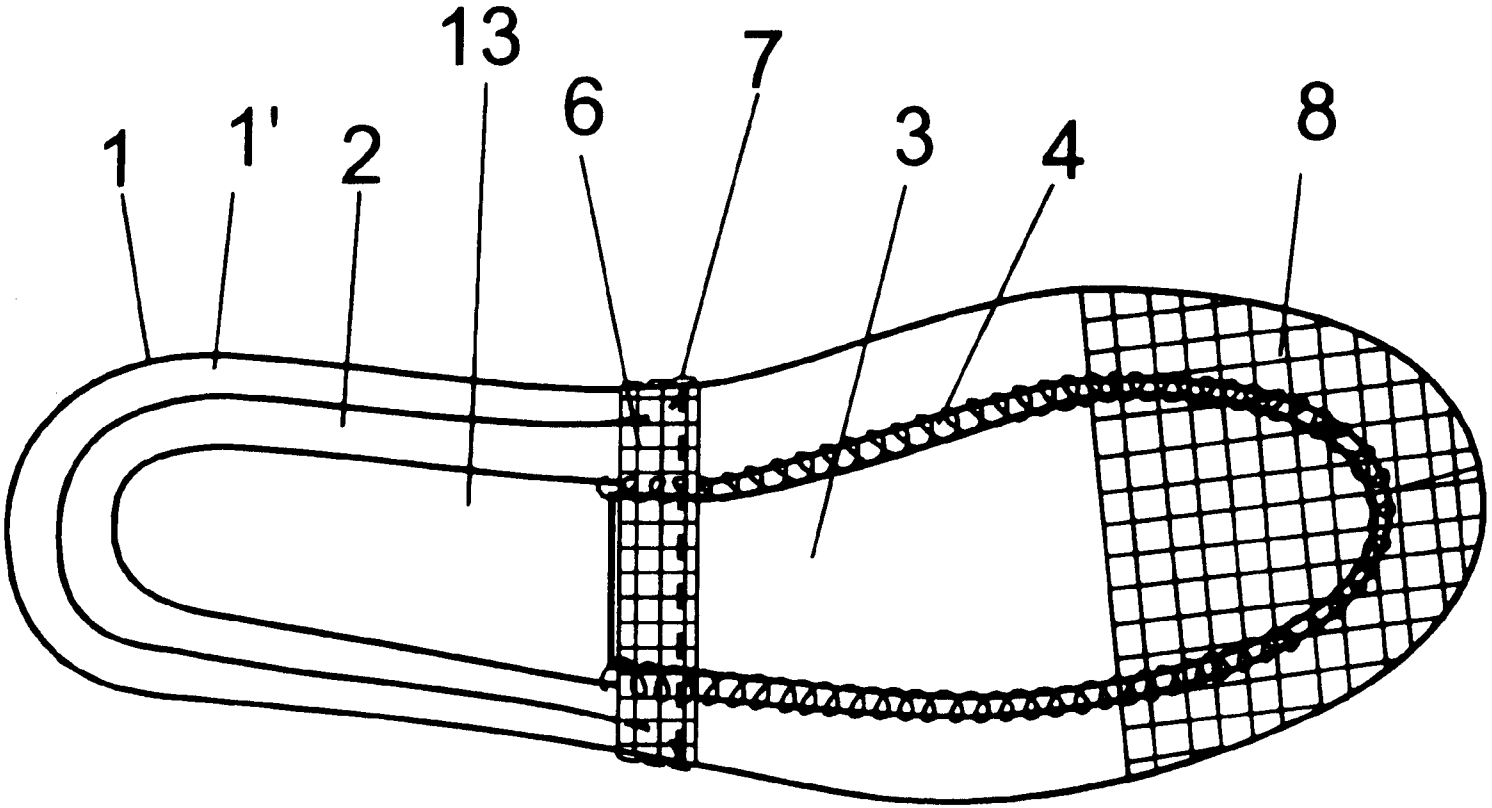
FIG. 6 shows a bottom view of a shoe in which the front part of the shoe is provided with the shoe structure of the invention while the rear part of the shoe, toward the heel, is produced using an adhesive lasting process.

FIG. 6 shows the bottom view of a shoe, the front part of which is provided with a shoe structure in accordance with the invention, while the rear part, i.e., the part of the shoe toward the heel, is manufactured in an adhesive lasting process. For this purpose, outer layer 1 in the heel area is extended downward and turned in such a way that the turned-in part 1' of outer layer 1 is oriented parallel to the outsole. In the region where outer layer 1 is turned in, the outer contour of insole 13 abuts the functional layer 2 (contour insole). Together with the functional layer 2, outer layer 1 is turned over the outer contour of insole 13. In this connection, the two parts of the insole, parts 3 and 13, can be manufactured as a unit or as two separate pieces. In the latter case the two pieces 3 and 13 overlap. FIG. 6 shows the case in which this overlap is realized in the area of the retention netting 6. In the illustrated embodiment of the shoe structure of the invention, in which the two pieces 3 and 13 of the insole overlap, the result is an extraordinary high degree of flexibility in the overlap region. For this reason, this overlap region should be located in the shoe where flexibility is required.

With the shoe structure in accordance with the invention, it is not necessary to have the outer layer glued to the lining. As a rule, it is sufficient to have retention netting sewn (by a Strobel process) to the outer layer, as previously explained, or to turn in the lower part of the outer layer. Even if the lower part of the outer layer is turned in, adhesive lasting—gluing to the turned-in end area of the lining—is not absolutely necessary, because retention is effected by the adhesive that is used to affix the outsole. That is why the shoe structure of the invention can be produced particularly economically.

What is claimed is:

1. Waterproof shoe structure comprising at least part of a shoe, comprising an outer layer, a lining comprising a functional layer that is waterproof but permeable to water vapor, an insole, and an outsole, whereby the lining containing the functional layer has a lower end area that is turned in and arranged parallel to the outsole, the turned-in end area lies in a common plane with the insole and has an inner edge and an outer edge, the outer edge of the insole runs at least approximately parallel to the inner edge of the turned-in end area, and the insole is joined to the turned-in end area, wherein the outsole is applied by adhesive over a full surface thereof at least to the turned-in end area of the functional layer of the lining, wherein the lower end of the upper layer is arranged substantially perpendicular to the outsole and at least in a shank area thereof is joined to a retainer arranged parallel to the outsole, and wherein the lining inside the outer layer is arranged in a detached manner.

2. Waterproof shoe structure according to claim 1, wherein the insole is sewn to the turned-in end area of the lining.

3. Waterproof shoe structure according to claim 1, wherein at least in the toe area a netting of monofilaments is joined to the lower end of the outer layer thus stabilizing the shape of the toe area of the outer layer.

4. Waterproof shoe structure according to claim 1, wherein at least in the shank area, a netting of monofilaments is joined to the lower ends of the outer layer thus stabilizing the shape of the outer layer.

5. Waterproof shoe structure according to claim 1, wherein the outer layer in the toe area is extended downward and turned in in such a way that the turned-in part of the outer layer is arranged parallel to the outsole.

6. Waterproof shoe structure according to claim 1, wherein the outer layer is extended downward in a heel area and turned in in such a way that the turned-in part of the outer layer is arranged parallel to the outsole.

7. Waterproof shoe structure according to claim 6, wherein, in the area in which the outer layer is turned in, the outer contour of the insole abuts the functional layer and the outer layer, together with the functional layer, is turned over the outer contour of the insole.

8. Waterproof shoe structure according to claim 1, wherein the lower end area of the outer layer is formed into a drawstring passage by turning back the lower end area and joining it to the outer layer, and that a cord is inserted into the drawstring passage to retain the lower end of the outer layer.

9. Waterproof shoe structure according to claim 8, characterized in that the drawstring passage is arranged in the toe area of the shoe and extends approximately up to the shank area of the shoe, and wherein the ends of the cord emerging from the drawstring passage in the shank area are directed inward and parallel to the outsole and are joined together.

10. Waterproof shoe structure according to claim 8, wherein the cord is a monofilament.

11. Waterproof shoe structure according to claim 1, wherein the outsole is affixed to the functional layer by a waterproof adhesive.

12. Waterproof shoe structure according to claim 1, wherein the lining is a laminate in which a lining layer is joined to the functional layer.

13. Waterproof shoe structure according to claim 12, wherein the side of the functional layer facing away from the lining layer is joined to a textile reinforcing layer and wherein the bonding of the outsole to the end area of the functional layer is effected in such a manner that the textile reinforcing layer is completely embedded in the adhesive layer required for bonding.

14. Waterproof shoe structure according to claim 13, wherein the textile reinforcing layer consists of monofilaments.

15. Waterproof shoe structure according to claim 1, wherein the lower end of the upper layer is arranged substantially perpendicular to the outsole and at least in a shank area thereof is joined to a retainer arranged parallel to the outsole, and at least in a toe area thereof a netting of monofilaments is joined to the lower end of the outer layer.

16. Waterproof shoe structure according to claim 2, wherein the insole is sewn to the turned-in end area of the lining by a Strobel process.

17. Waterproof shoe structure according to claim 3, wherein said netting of monofilaments is joined to the lower end of the outer layer by sewing.

18. Waterproof shoe structure according to claim 4, wherein said netting of monofilaments is joined to the lower ends of the outer layer by sewing.

19. Waterproof shoe structure according to claim 1, wherein the retainer is joined only to the lower end of the upper layer.

* * * * *

UNITED STATES PATENT AND TRADEMARK OFFICE

CERTIFICATE OF CORRECTION

PATENT NO. : 6,035,555

DATED : March 14, 2000

INVENTOR(S) : Liviu-Mihai PAVELESCU and Manfred HADERLEIN

It is certified that error appears in the above-indentified patent and that said Letters Patent is hereby corrected as shown below:

Column 3, lines 12-14, delete "perpendicular to the outsole and join it, at least in the area of the shank, to a retainer that is parallel to the insole."; and delete lines 15-51.

Column 5, line 28, after "turned in" insert --in --.

Signed and Sealed this

Third Day of April, 2001

*Attest:*

Nicholas P. Godici

NICHOLAS P. GODICI

*Attesting Officer*

*Acting Director of the United States Patent and Trademark Office*